US008176677B1

(12) United States Patent
Blackmon, III

(10) Patent No.: US 8,176,677 B1
(45) Date of Patent: May 15, 2012

(54) AUTOMATED GUIDE RAIL APPARATUS

(76) Inventor: Baron H. Blackmon, III, Darlington, SC (US)

( * ) Notice: Subject to any disclaimer, the term of this patent is extended or adjusted under 35 U.S.C. 154(b) by 1114 days.

(21) Appl. No.: 12/038,258

(22) Filed: Feb. 27, 2008

(51) Int. Cl.
*E01F 13/00* (2006.01)

(52) U.S. Cl. ..... 49/49; 49/25; 49/28; 49/124; 49/323; 49/404

(58) Field of Classification Search ..... 49/49, 25, 49/26, 28, 124, 323, 404, 360; 105/341, 105/425
See application file for complete search history.

(56) References Cited

U.S. PATENT DOCUMENTS

| | | | | | |
|---|---|---|---|---|---|
| 441,226 | A | * | 11/1890 | Blethen et al. | 49/124 |
| 3,257,756 | A | | 6/1966 | Mealer | |
| 3,606,699 | A | * | 9/1971 | Robinson | 49/280 |
| 3,613,314 | A | | 10/1971 | Ford | |
| 3,775,906 | A | * | 12/1973 | Dougherty | 49/358 |
| 4,313,281 | A | * | 2/1982 | Richmond | 49/280 |
| 4,366,649 | A | | 1/1983 | Weigant | |
| 4,488,326 | A | | 12/1984 | Cherry | |
| 4,577,577 | A | * | 3/1986 | Eriksson | 114/120 |
| D284,704 | S | | 7/1986 | Malkmus-Dornemann | |
| 4,791,757 | A | * | 12/1988 | Orlando | 49/360 |
| 4,796,011 | A | * | 1/1989 | Lemirande et al. | 340/686.1 |
| 4,855,653 | A | * | 8/1989 | Lemirande | 318/282 |
| 5,076,012 | A | * | 12/1991 | Richmond et al. | 49/28 |
| 5,261,187 | A | | 11/1993 | Prenger | |
| 5,579,608 | A | * | 12/1996 | Dunn | 49/404 |
| 5,581,944 | A | * | 12/1996 | Kornbrekke et al. | 49/28 |
| 5,873,205 | A | * | 2/1999 | Hanlon et al. | 52/239 |
| 6,091,217 | A | * | 7/2000 | Parsadayan | 318/285 |
| 6,092,338 | A | * | 7/2000 | Crowner et al. | 49/360 |
| 6,346,786 | B1 | * | 2/2002 | Wood et al. | 318/264 |
| 6,507,160 | B2 | | 1/2003 | Wood et al. | |
| 2010/0024307 | A1 | * | 2/2010 | Dale et al. | 49/360 |

FOREIGN PATENT DOCUMENTS

| | | | | |
|---|---|---|---|---|
| DE | 4200092 | A1 | * | 7/1993 |
| GB | 2225469 | A | * | 5/1990 |
| GB | 2274131 | A | * | 7/1994 |
| JP | 04140392 | A | * | 5/1992 |

* cited by examiner

*Primary Examiner* — Jerry Redman

(57) ABSTRACT

An automated guide rail apparatus includes a fixed wall that includes a pair of vertical supports attached to and extending upwardly from a floor surface and a horizontal support attached to the vertical supports. The fixed wall is positioned adjacent to a hazardous area. A movable wall is attached to the fixed wall and is movable laterally toward or extended away from the fixed wall to increase or decrease a combined length of the fixed and movable walls. The movable wall prevents access to the hazardous area when the movable wall is extended away from the fixed wall. A drive assembly is mounted on the fixed wall and moves the movable wall outwardly from the fixed wall when the drive assembly is actuated. An actuating assembly is in communication with the drive assembly to actuate the drive assembly when a hazardous condition is determined by the actuating assembly.

8 Claims, 8 Drawing Sheets

AUTOMATED GUIDE RAIL APPARATUS

BACKGROUND OF THE INVENTION

1. Field of the Invention

The present invention relates to guide rail devices and more particularly pertains to a new guide rail device for preventing access to an area when a hazardous condition exists in that area.

2. Summary of the Invention

The present invention meets the needs presented above by generally comprising a fixed wall that includes a pair of vertical supports attached to and extending upwardly from a floor surface and a horizontal support attached to the vertical supports. The fixed wall is positioned adjacent to a hazardous area. A movable wall is attached to the fixed wall and is movable laterally toward or extended away from the fixed wall to increase or decrease a combined length of the fixed and movable walls. The movable wall prevents access to the hazardous area when the movable wall is extended away from the fixed wall. A drive assembly is mounted on the fixed wall and moves the movable wall outwardly from the fixed wall when the drive assembly is actuated. An actuating assembly is in communication with the drive assembly to actuate the drive assembly when a hazardous condition is determined by the actuating assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
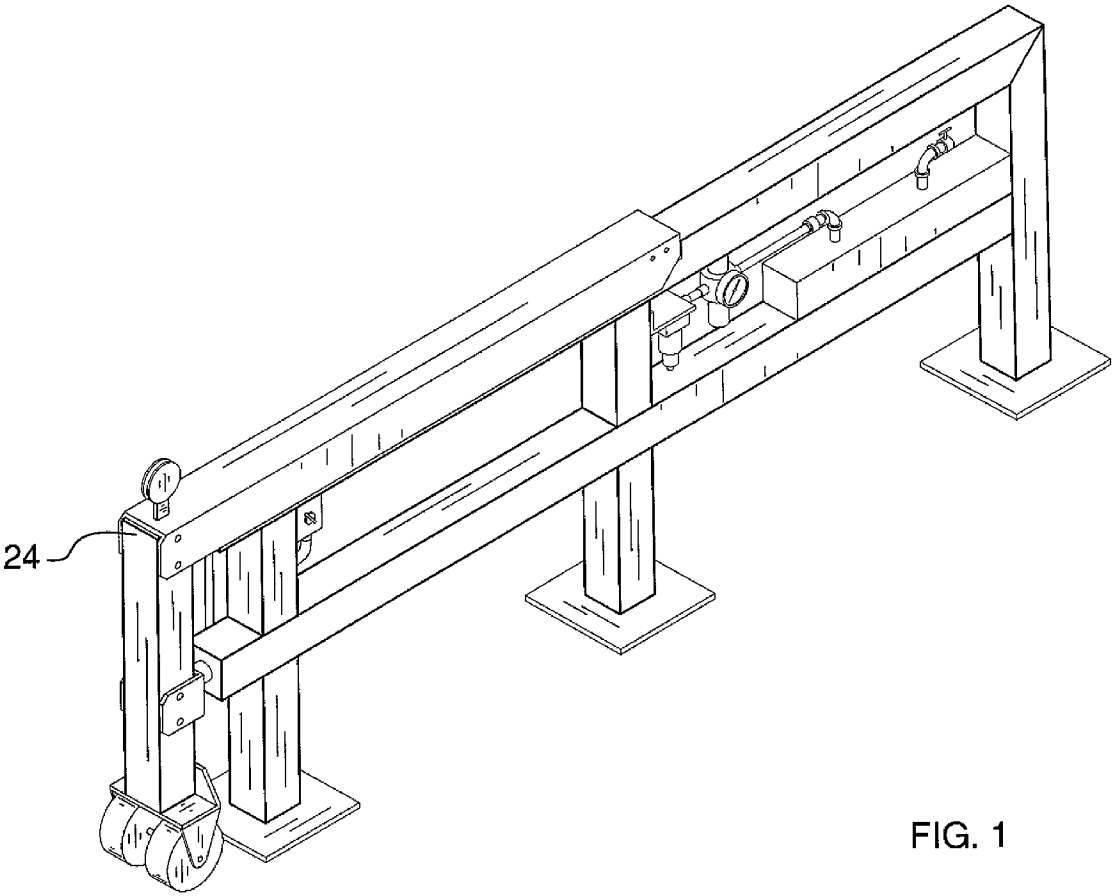
FIG. 1 is a front perspective view of a automated guide rail apparatus according to the present invention.
Figure 2:
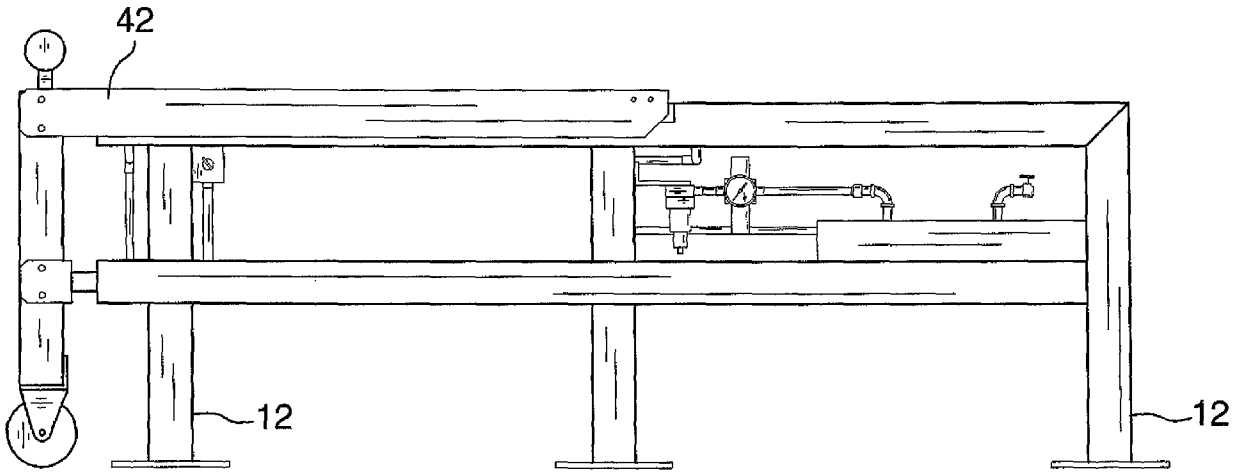
FIG. 2 is a front view of the present invention.
Figure 3:
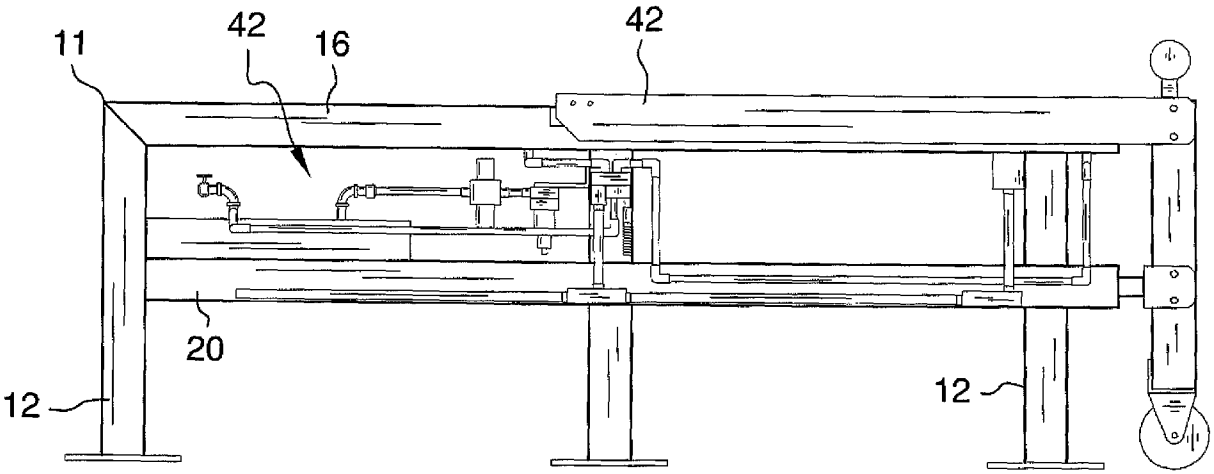
FIG. 3 is a back view of the present invention.
Figure 4:
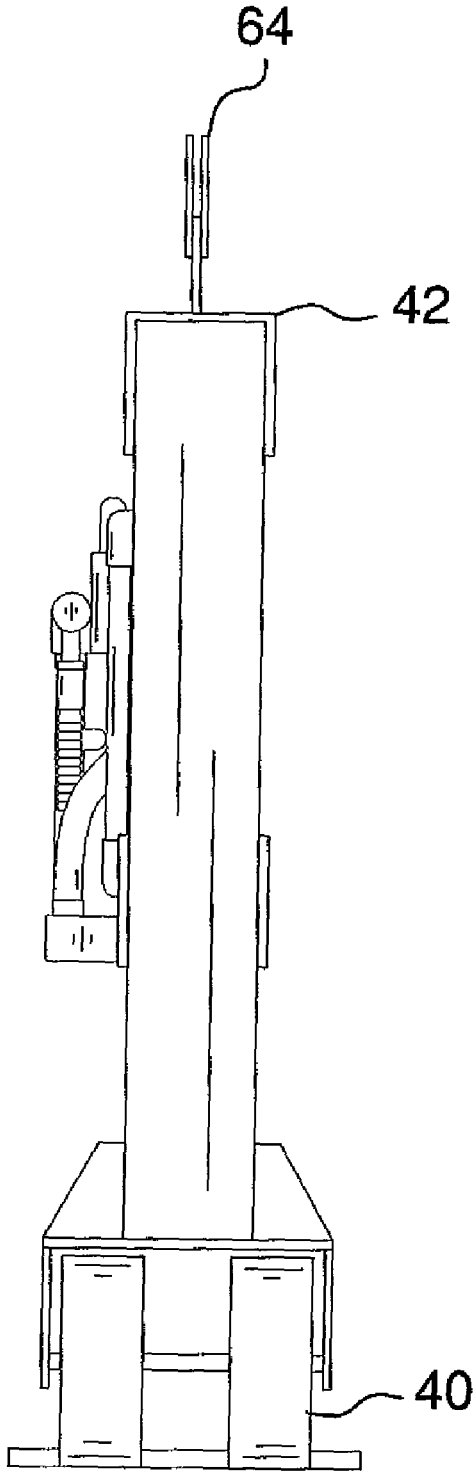
FIG. 4 is a left side view of the present invention.
Figure 5:
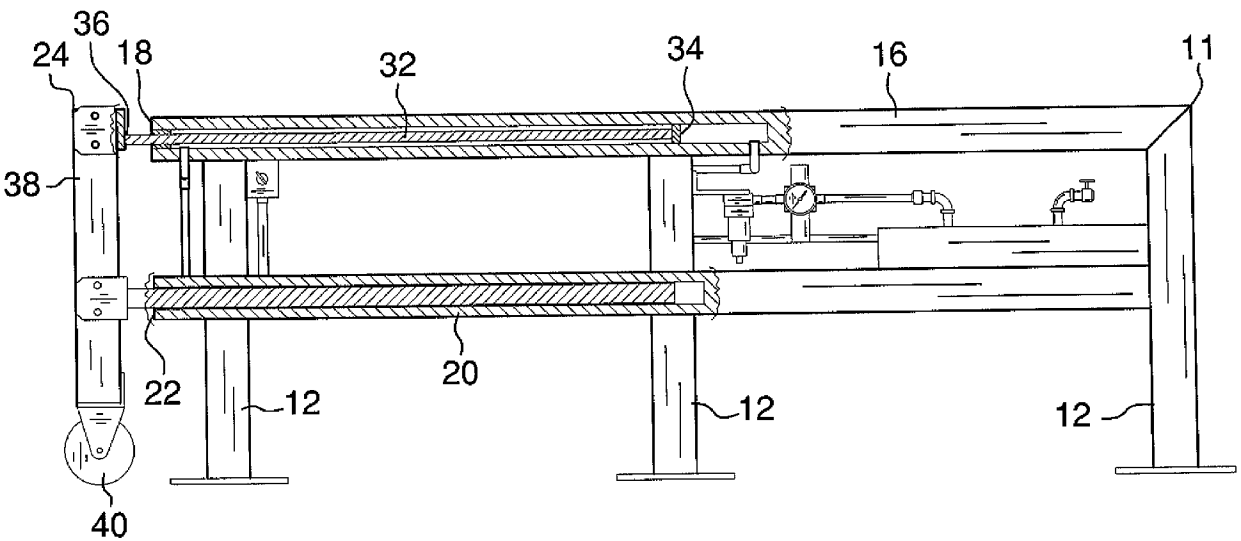
FIG. 5 is a broken front view of the present invention.
Figure 6:
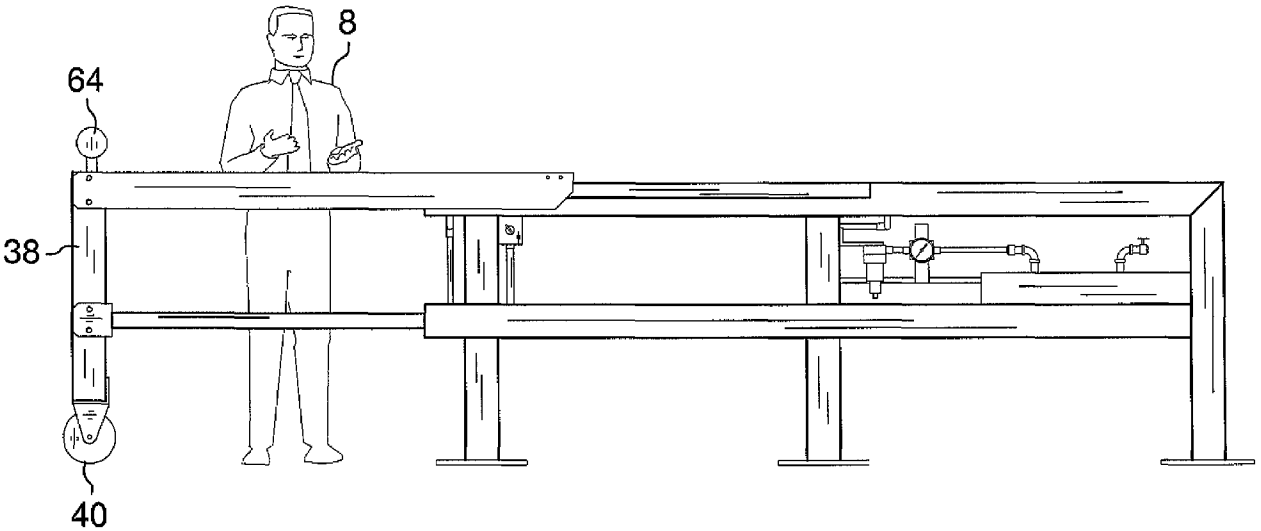
FIG. 6 is a front in-use view of the present invention.
Figure 7:
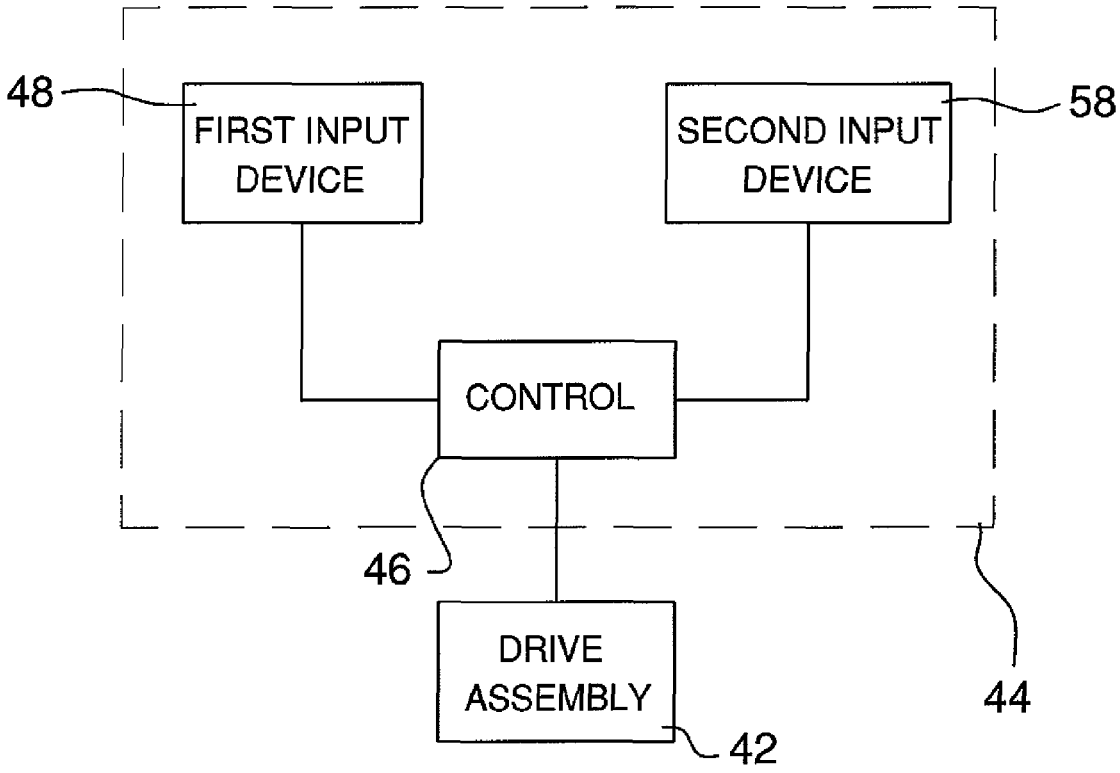
FIG. 7 is a schematic view of the present invention.
Figure 8:
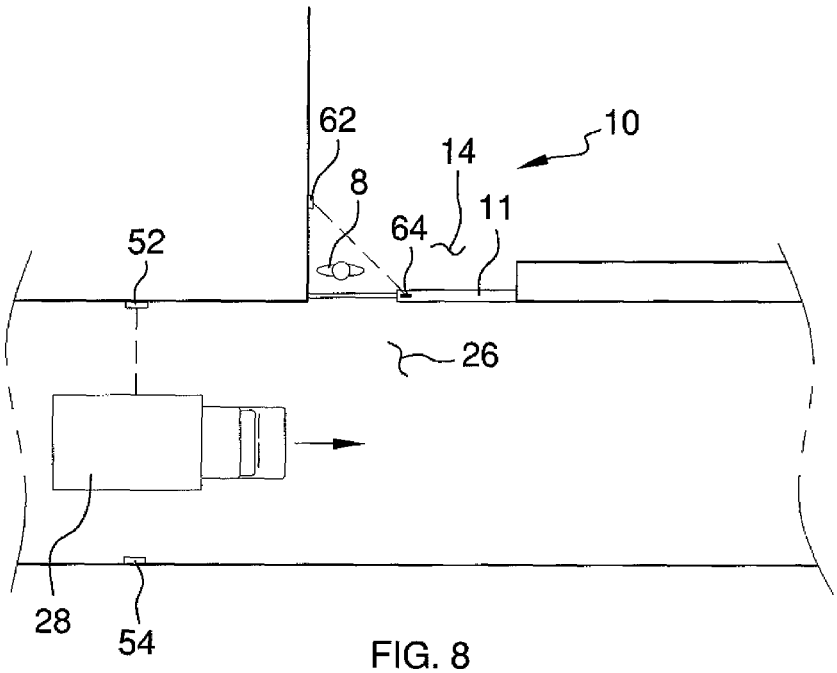
FIG. 8 is a top in-use view of the present invention.
Figure 9:
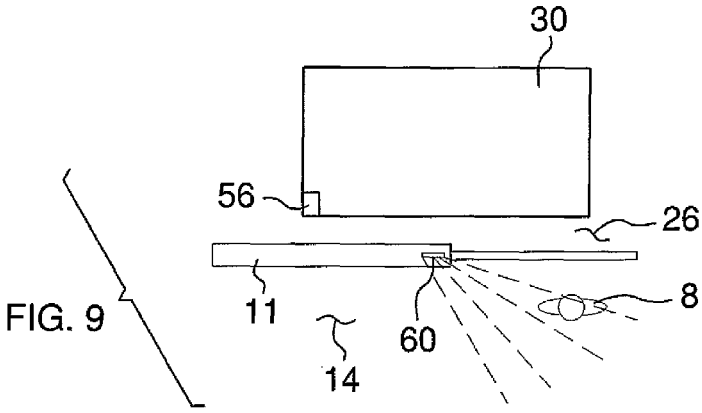
FIG. 9 is a top in-use view of the present invention.

With reference now to the drawings, and in particular to FIGS. 1 through 9 thereof, a new guide rail device embodying the principles and concepts of the present invention and generally designated by the reference numeral 10 will be described.

As best illustrated in FIGS. 1 through 9, the automated guide rail apparatus 10 generally comprises a fixed wall 11 that includes a pair of vertical supports 12 that is attached to and extend upwardly from a floor surface 14 and a horizontal support 16 is attached to the vertical supports 12. The fixed wall 11 is positioned adjacent to a hazardous area. The horizontal support 16 has an open end 18. A secondary horizontal support 20 may also be included which also has an open end 22. The horizontal supports 16, 20 extend outwardly from one end of the fixed wall 11 and away from an adjacent one of the vertical supports 12.

A movable wall 24 is attached to the fixed wall 11. The movable wall 24 is movable laterally toward or extended away from the fixed wall 11 to increase or decrease a combined length of the fixed 11 and movable 24 walls. The movable wall 24 prevents access to the hazardous area 26 when the movable wall 24 is extended away from the fixed wall 11. The hazardous area 26 may include any access controllable hazardous area such a vehicle 28 through-way within a building or a factory machine 30 having exposed moving parts. The movable wall 24 includes an elongated arm 32 that has a first end 34 and a second end 36. The first end 34 is positioned within the horizontal support 16 and the arm 32 extends outwardly of the open end 18. A leg 38 is attached to the second end 36 of the arm 32 and extends downwardly from the arm 32 to the floor surface 14. A bottom end 40 of the leg 38 comprises a rotatable wheel. The movable wall 24 has a length between 3 feet and 8 feet. A safety shield 42 is positioned on the arm 32.

A drive assembly 42 is mounted on the fixed wall 11 and moves the movable wall 24 outwardly from or toward the fixed wall 11 when the drive assembly 42 is actuated. The drive assembly 42 may include a conventional pneumatic actuating system for forcing air into the horizontal support 16 to urge the arm 32 outwardly of the horizontal support 16. Mechanical or fluidic means may be utilized to retract the movable wall 24. Alternatively, after the movable wall 24 has been extended, it may be retracted back toward the fixed wall 11 by hand.

An actuating assembly 44 is in communication with the drive assembly 42 to actuate the drive assembly 42 when a hazardous condition is determined by the actuating assembly 44. The actuating assembly 44 includes a control 46 electrically coupled to the drive assembly. The control 46 may include a conventional processor programmed to actuate the drive assembly 42. A first input device 48 is in communication with the control 46. The first input device 48 detects hazardous action in the hazardous area 26. The first input device 48 may include a motion sensor, a pressure plate, a light beam sensor 52 and reflector 54 which is tripped when the light beam is broken, or a connection 56 to a piece of hazardous equipment to determine if that piece of equipment has been turned on. A second input 58 is in communication with the control 46. The second input 58 detects movement adjacent to the fixed wall 11. The second input may comprise a motion sensor 60 or a light beam sensor 62 and reflector 64 to detect if a person 8 is moving toward an opening which will be closed when the movable wall 24 is extended away from the fixed wall 11.

In use, the control 46 determines the hazardous condition exists and then extends the movable wall 24 if the second input 58 detects movement adjacent to the fixed wall 11 while the first input 48 detects the hazardous action. This will prevent a person 8 from accidentally entering the hazardous area 26. Once the hazardous action has passed, either the drive assembly 42 will retract the movable wall 24 or the person 8 wishing to enter the hazardous area 26 will open the movable wall 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automated guide rail system comprising:

a fixed wall including a pair of vertical supports being attached to and extending upwardly from a floor surface and a horizontal support being attached to said vertical supports, said fixed wall being positioned adjacent to a hazardous area;

a movable wall being attached to said fixed wall, said movable wall being movable laterally toward or extended away from said fixed wall to increase or decrease a combined length of said fixed and movable walls, said movable wall preventing access to said hazardous area when said movable wall is extended away from said fixed wall;

a drive assembly being mounted on said fixed wall and moving said movable wall outwardly from said fixed wall when said drive assembly is actuated; and an actuating assembly being in communication with said drive assembly to actuate said drive assembly when a hazardous condition is determined by said actuating assembly, said actuating assembly including;

a control electrically coupled to said drive assembly;

a first input device being in communication with said control, said first input device detecting hazardous action in said hazardous area, said hazardous action being a piece of equipment in said hazardous area being turned on; and a second input being in communication with said control, said second input detecting movement adjacent to said fixed wall, said control extending said movable wall if said second input detects movement adjacent to said fixed wall while said first input detects the hazardous action.

2. The system according to claim 1, wherein said horizontal support has an open end, said movable wall including an elongated arm having a first end and a second end, said first end being positioned within said horizontal support and said arm extending outwardly of said open end, a leg being attached to said second end of said arm and extending downwardly from said arm to the floor surface.

3. The system according to claim 2, wherein a bottom end of said leg comprises a rotatable wheel.

4. The system according to claim 1, further including a safety shield being mounted on said arm and extending over said horizontal support at a juncture of said arm and said horizontal support.

5. An automated guide rail system comprising:

a fixed wall including a pair of vertical supports being attached to and extending upwardly from a floor surface and a horizontal support being attached to said vertical supports, said fixed wall being positioned adjacent to a hazardous area, said horizontal support having an open end;

a movable wall being attached to said fixed wall, said movable wall being movable laterally toward or extended away from said fixed wall to increase or decrease a combined length of said fixed and movable walls, said movable wall preventing access to said hazardous area when said movable wall is extended away from said fixed wall, said movable wall including an elongated arm having a first end and a second end, said first end being positioned within said horizontal support and said arm extending outwardly of said open end, a leg being attached to said second end of said arm and extending downwardly from said arm to the floor surface, a bottom end of said leg comprising a rotatable wheel;

a drive assembly being mounted on said fixed wall and moving said movable wall outwardly from or toward said fixed wall when said drive assembly is actuated;

an actuating assembly being in communication with said drive assembly to actuate said drive assembly when a hazardous condition is determined by said actuating assembly, said actuating assembly including;

a control electrically coupled to said drive assembly;

a first input device being in communication with said control, said first input device detecting hazardous action in said hazardous area, said hazardous action being a piece of equipment in said hazardous area being turned on; and a second input being in communication with said control, said second input detecting movement adjacent to said fixed wall, said control determining said hazardous condition exists and extending said movable wall if said second input detects movement adjacent to said fixed wall while said first input detects the hazardous action.

6. The system according to claim 5, further including a safety shield being mounted on said arm and extending over said horizontal support at a juncture of said arm and said horizontal support.

7. An automated guide rail system comprising:

a fixed wall including a pair of vertical supports being attached to and extending upwardly from a floor surface and a horizontal support being attached to said vertical supports, said fixed wall being positioned adjacent to a hazardous area;

a movable wall being attached to said fixed wall, said movable wall being movable laterally toward or extended away from said fixed wall to increase or decrease a combined length of said fixed and movable walls, said movable wall preventing access to said hazardous area when said movable wall is extended away from said fixed wall;

a drive assembly being mounted on said fixed wall and moving said movable wall outwardly from said fixed wall when said drive assembly is actuated; and an actuating assembly being in communication with said drive assembly to actuate said drive assembly when a hazardous condition is determined by said actuating assembly;

said horizontal support having an open end;

said movable wall including an elongated arm having a first end and a second end, said first end being positioned within said horizontal support and said arm extending outwardly of said open end, a leg being attached to said second end of said arm and extending downwardly from said arm to the floor surface; and a safety shield being mounted on said arm and extending over said horizontal support at a juncture of said arm and said horizontal support.

8. The system according to claim 7, wherein a bottom end of said leg comprises a rotatable wheel.

* * * * *